United States Patent [19]

Burns

[11] Patent Number: 4,734,051

[45] Date of Patent: Mar. 29, 1988

[54] ELECTRICAL CONNECTOR BUTT CONTACT

[75] Inventor: Edgar Burns, Los Angeles, Calif.

[73] Assignee: G & H Technology, Inc., Santa Monica, Calif.

[21] Appl. No.: 9,936

[22] Filed: Feb. 2, 1987

[51] Int. Cl.[4] ..... H01R 25/00

[52] U.S. Cl. ..... 439/289; 439/819

[58] Field of Search ..... 339/47–49, 339/255 R; 439/284, 286, 289, 294, 295, 819, 824

[56] References Cited

U.S. PATENT DOCUMENTS

| | | | |
|---|---|---|---|
| 1,300,789 | 4/1919 | Tomlinson | 339/49 B |
| 2,736,870 | 2/1956 | De Jur et al. | 339/48 |
| 3,646,498 | 2/1972 | Reed | 339/48 |
| 3,771,110 | 11/1973 | Reed | 339/48 |
| 4,643,513 | 2/1987 | Martin | 439/819 |
| 4,690,648 | 9/1987 | Urani | 439/819 |

*Primary Examiner*—Gil Weidenfeld
*Assistant Examiner*—Paula A. Austin
*Attorney, Agent, or Firm*—George J. Netter

[57] ABSTRACT

An electrical connector part has its connector end covered by a metal shield or grid plate having openings individually aligned with electrical contacts. The electrical contacts are of the "butt" variety having spring-loaded parts which shieldingly cover the grid plate openings when the connector parts are released.

5 Claims, 2 Drawing Figures

ELECTRICAL CONNECTOR BUTT CONTACT

The present invention relates generally to electrical connector contacts, and, more particularly, to improved butt contacts which close off the metal shell of a connector part to external electromagnetic interference when the connector parts are unmated.

BACKGROUND

Releasable electrical connectors include internal contacts which are engaged on mating of the connector parts to interconnect cable wires in a desired manner. Although the connector metal shell parts typically shield the contacts from external electromagnetic interference when the connector is mated, it is essential in many situations that the contacts within a connector part shell be shielded from electromagnetic interference when the connector part is unmated. One type of electrical contact commonly referred to as a "butt" contact establishes electrical connection by surface contacting between the contact parts without trapping or locking contact parts together. A well-known example of butt contacts includes a springlike member in the form of a bellows which can be displaced both axially and transversely by movements of a male contact in pressure exerting relationship therewith.

In a copending application Ser. No. 889,943, filed July 28, 1986, now U.S. Pat. No. 4,707,044, "BUTT CONTACTS FOR AN ELECTRICAL CONNECTOR" by E. Burns, assigned to the same assignee as the present application, a butt contact for cooperating with a male pin contact includes a metal shell end part that is telescopically received on a metal shaft with spring means providing resilient movement of the shell thereon. When the connector parts are mated, the male contact pin is received within a concavity at the end of the shell compressing the spring means to establish the desired electrical connection. The pin end can be released from the shell of the second contact by either axial or transverse relative movement. In an alternate contact version of the copending application, a flange on the movable shell of the one contact is held in flush contacting relation to the edges of a hole in a grid plate when the connector parts are unmated serving to provide an electromagnetic shield against external interfering fields. In this second version, mating of the connector parts automatically breaks the grid plate short-circuit while establishing electrical connection between the two contacts.

SUMMARY OF THE PRESENT INVENTION

In the practice of the present invention, a first contact for mounting within one connector part of a releasable electrical connector is of one-piece construction, one end of which is hollowed out to receive a cable wire therein and either crimped or soldered in place. The other contact end includes an elongated pin having a slotted end to provide a springlike resiliency when coating with a second contact to be described. Between the pin end and the cable receiving end there is an enlarged cylindrical flange which serves as a means for locking engagement within a connector part.

A second contact mounted within the other connector part for coacting with the first or pin contact includes as a central member, a pin contact which can be identical in construction to the first contact. A coil spring is located on the pin, the inner end of which can either abut directly against the flange or against a collet portion extending forwardly of the flange. a tubular insulator having an internal diameter substantially identical to that of the connector pin is slidingly received thereon and is resiliently urged by the spring means axially of the pin. A metal grid plate integral with the connector part housing shell enclosing the second contact includes an opening which is oversized to and aligned with the contact pin. An insulator is received over the outer surface of the grid plate and includes a necked-down portion fitting into the grid plate opening. A hollow metal shell has one closed end which is shaped to be concave outwardly and the other end open with an enlarged outwardly extending flange. The shell is slidingly received within the opening of the insulator necked-down portion with the flange abutting against the outer end of the insulative tube.

On mating of the connector parts, the pin contact is received within the concave end of the shell and moves the shell along the insulator hole simultaneously moving the insulative tube along the pin part of the contact against the spring means which movement is continued until the pin part is received within the hollow shell. In this way there is a current path established between the pin contact and the second contact. Upon release or unmating movement, the spring means acting on the insulative tube drives the flange portions of the connector shell away from the pin part breaking electrical contact with it, and then establishing electrical contact with the grid plate closes off the opening to access from external interfering fields.

DESCRIPTION OF A PREFERRED EMBODIMENT

Figure 1:
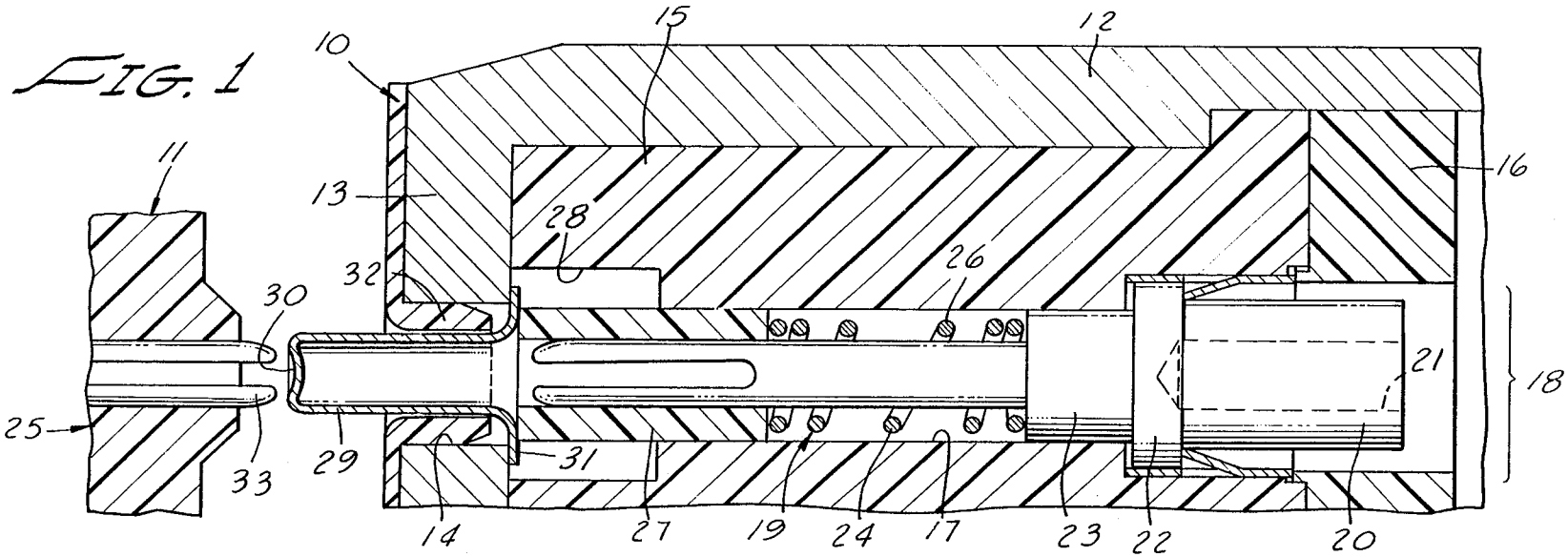
FIGS. 1 and 2 are side elevational, sectional views of the butt contacts of this invention showing the connector parts with such contacts mounted therein in the unmated and mated conditions, respectively.

Turning now to the drawings, there is shown two electrical connector parts identified generally as 10 and 11 which upon being releasably joined interconnect selected pairs of cable wires via contacts to be described. These electrical connector parts and their coaction are well-known and, therefore, a detailed description thereof will not be given. The connector part 10 consists generally of a cylindrical metal shell 12 serving as the connector housing and across one face of which extends an integral grid plate 13 having a plurality of openings therein 14 aligned with which are electrical contacts to be described. The interior of the connector shell 12 includes one or more insulative inserts 15 and 16 having a suitably shaped opening 17 for receiving a first contact enumerated as 18. The connector contact 18 includes a contact central member 19 which is constructed similar to what is referred to as a pin contact in conventional releasable electrical connectors. More particularly, the member 19 includes an enlarged cylindrical end portion 20 which is hollowed out at 21 for receiving a cable wire (not shown) therein to which it can be affixed by either crimping or soldering, as desired. An enlarged circular flange 22 is integral therewith and from which extends a hub 23 and integral therewith an elongated cylindrical pin 24. The end portion of the pin 24 is slotted and its tip is radiused for a purpose to be described.

Not only is the central member 19 an essential part of the contact 18, but also as it is constructed it can also be used as the second contact identified as 25 to be mounted in the connector part 11 for mating with the contact 18, as will be described.

The insulative insert opening 17 is of such dimensions as to receive the hub 23 in fitting relationship therein. A coil spring 26 is mounted on the pin 24 with one end abutting against the outer surface of the hub 23. An insulative sleeve 27 has an internal diameter such as to enable sliding receipt onto the pin 24, the inner end of which will bear against the spring 26. The outer diameter of the sleeve 27 slidingly fits within insert opening 17, the latter opening communicating with an enlarged cavity 28.

A cylindrical metal shell 29 has one closed end 30 which has its surface formed to be outwardly concave. The opposite or open end terminates in a radially outwardly extending flange 31. Preferably, the shell 29 is constructed of a good electrical conductor, such as beryllium copper, for example.

In assembly, after the insulator 32 with hollow hubs 33 is attached to the grid, the shell 29 is inserted into the insulator opening from the interior side and the inserts 15 and 16 and central member 19 are then located within the connector shell 12. The opening in the hubs 33 is such as to readily receive the shell 29 therethrough in a free sliding relation so as not to frictionally impede movement of the shell therealong.

Although not shown, the connector part 11 is constructed generally as the connector part 10 already described in having a cylindrical metal housing with insulative inserts and within which inserts a pin contact, which can be identical to the central member 19 of the connector 18, and which is identified as 34.

When the connector parts are unmated as in FIG. 1, the spring 26 urges the insulating tube 27 against the flanges 31 of the cylindrical shell 29 forcing them into direct contact with the grid plate walls immediately adjacent the opening 14. In this way, the entire interior of the connector shell 12 is enclosed by a metal shield preventing pollution from external interfering fields.

Figure 2:
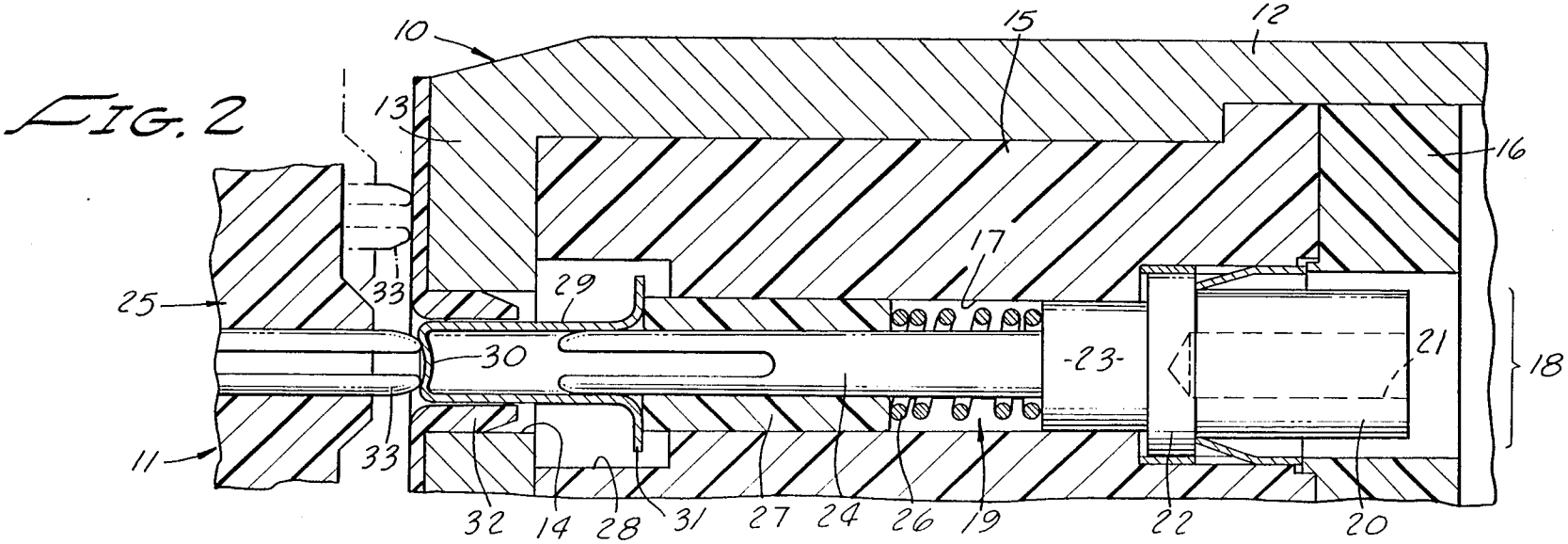

When the two connector parts 10 and 11 are mated, the male contact 34 is moved to bring its slotted end within the concave end 30 of the contact 18 and this movement is continued forcing the shell 29 until it is received on the end portion of the pin 24 as shown in FIG. 2. At this time, there is a direct electrical interconnection between a cable wire connected to the contact 34 through the shell 29 and central member 19 to a cable wire interconnected to the end portion 20 of contact 18.

The slotted end of the pin 24 is slightly larger than the internal dimensions of shell 29 such that the pin end is compressed slightly upon being received within the shell thereby insuring a good pressure exerting connection therebetween.

The slotted end of the male contact 34 on being received within the concave end 30 of the shell 29 is similarly laterally compressed a slight amount which serves to effect a spring loading and, more particularly, a wiping action serving to remove any oxides or other surface films that may have been produced on the shell 29 and contact 34.

Although only one set of contacts are shown, and described, in the usual case a plurality of such paired contacts will be provided in any one connector which will be interconnected and disconnected at one time.

I claim:

1. A contact for use in a releasable electrical connector, comprising:

a generally cylindrical body having an enlarged circular flange, a hollow tubular portion extending from one face of the flange, and a pin extending from the opposite flange face;

coil spring means received on said pin contacting a hub extending from the flange;

an insulative sleeve received on the pin outwardly of the coil spring means and having one end abutting against said spring means; and a cylindrical metal shell having a closed end and an open end abutting against the other end of said insulative sleeve.

2. A contact as in claim 1, in which the metal sleeve closed end is formed into an outwardly directed concavity.

3. A contact as in claim 1, in which the metal sleeve at its open end is formed into a radially outwardly directed flange.

4. A contact as in claim 1, in which the pin outer end portion is slotted, and the dimensions of the pin outer end portion are such that they can be compressingly received within the shell open end.

5. A contact for use in one part of a releasable electrical connector which connects selected pairs of cable wires, which connector part has a metal grid plate conductively secured to a metal shell for the connector part, said grid plate having an opening therethrough aligned with the contact mounted within the metal shell, comprising:

an elongated metal body with one end hollowed out for receiving a cable wire therewithin, the other end being formed into a slotted pin, and a radially outwardly extending flange centrally located on the body;

compression spring means received on the pin abutting against a hub extending from the body flange;

an insulative sleeve received on the pin contacting the spring means;

a hollow metal sleeve with one closed end wall portion received within an opening of the grid plate and a flanged open end abutting against the insulative sleeve outer end; and an insulative guide received about the metal sleeve and positioned within the grid plate opening;

said metal sleeve flange being resiliently pressed against the grid plate by the spring means acting through the insulative sleeve when the spring means is in its fully extended condition.

* * * * *